United States Patent [19]

Bonfils et al.

[11] 4,190,434

[45] Feb. 26, 1980

[54] THERMAL PROCESSES FOR THE PRODUCTION OF MAGNESIUM

[75] Inventors: Rene Bonfils, Barbazan; Andre Mena, Saint Beat; Christian Payn, Barbazan; Louis Septier, Le Fayet, all of France

[73] Assignee: Societe Francaise d'Electrometallurgie "Sofrem", Paris, France

[21] Appl. No.: 915,387

[22] Filed: Jun. 14, 1978

[30] Foreign Application Priority Data

Jun. 24, 1977 [FR] France ..... 77 20227

[51] Int. Cl.[2] ..... C22B 4/00

[52] U.S. Cl. ..... 75/10 R; 75/67 R; 75/67 A; 75/24

[58] Field of Search ..... 75/67 R, 10 R, 10 A, 75/24, 67 A

[56] References Cited

U.S. PATENT DOCUMENTS

| | | | |
|---|---|---|---|
| 2,971,833 | 2/1961 | Artru et al. | 75/10 |
| 3,658,509 | 4/1972 | Avery | 75/67 R |
| 3,681,053 | 8/1972 | Avery | 75/67 R |
| 3,698,888 | 10/1972 | Avery | 75/67 R |
| 3,994,717 | 11/1976 | Avery | 75/67 R |
| 4,033,758 | 7/1977 | Johnston et al. | 75/67 R |
| 4,033,759 | 7/1977 | Johnston et al. | 75/67 R |
| 4,066,445 | 1/1978 | Johnston et al. | 75/67 R |

FOREIGN PATENT DOCUMENTS 1194556 5/1959 France .

*Primary Examiner*—L. Dewayne Rutledge
*Assistant Examiner*—John P. Sheehan
*Attorney, Agent, or Firm*—McDougall, Hersh & Scott

[57] ABSTRACT

This invention relates to the thermal production of magnesium, using, as source of magnesium oxide, a residual slag from the manufacture of certain carbon-containing chrome irons and, as reducing agent, a ferro-silico-aluminum for carrying out the MAGNETHERM process. Magnesium is obtained with a high degree of purity and in excellent yields, with the recovery of a residual alloy containing chromium and silicon, and the production capacity of a given furnace is increased by about 16% compared with that obtained when using calcined dolomite.

7 Claims, 3 Drawing Figures

THERMAL PROCESSES FOR THE PRODUCTION OF MAGNESIUM

The present invention relates to improvements to thermal processes for the production of magnesium.

It is known to produce magnesium by the reduction of substances containing magnesium oxide, using various reducing agents such as silicon, aluminum or calcium, either separately or as mixtures, or alloys with each other, or with other elements such as iron.

The MAGNETHERM process, which is the best known of these processes, described in French Pat. No. 1,194,556, enables magnesium to be obtained by reduction at a high temperature of a substance containing magnesium oxide by means of a reducing agent whose products of oxidation are not gaseous at the reaction temperature, the said substance which contains magnesium oxide and the said reducing agent being delivered to the surface of a bath of slag kept liquid by an electric current at a pressure above 1.8 millibars so that the magnesium vapors obtained are condensed in the liquid state.

Figure 1:
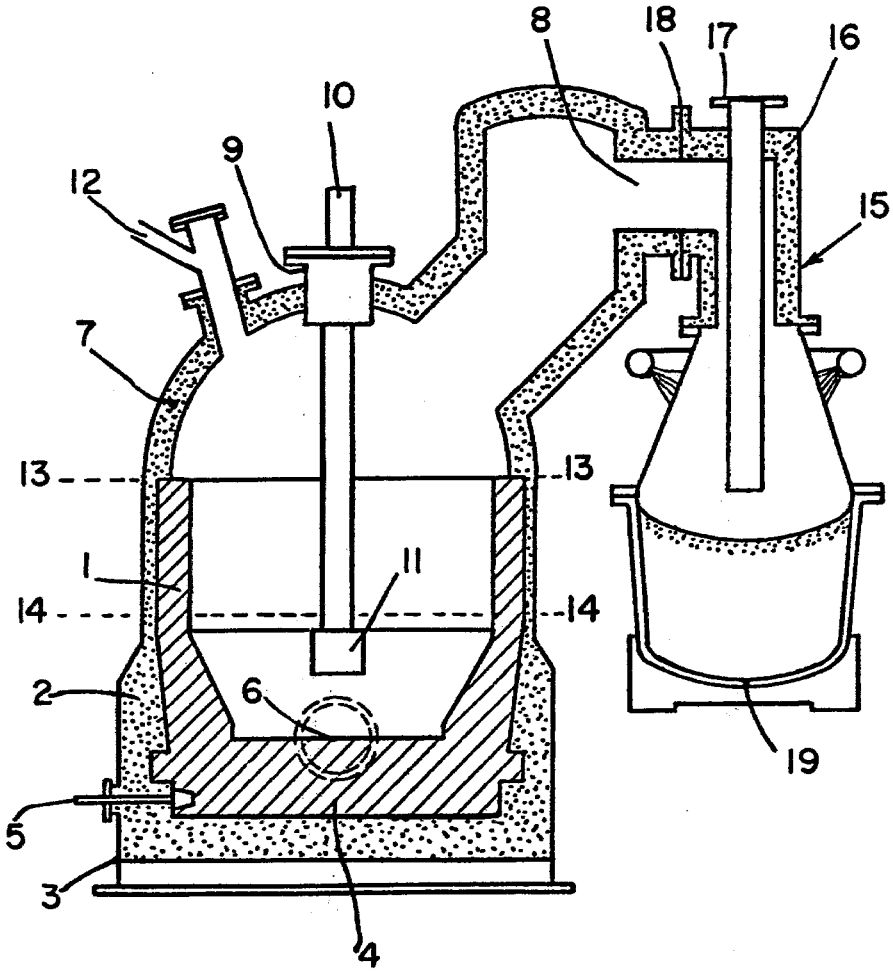
FIG. 1. is a schemitic representation reduced to the essential elements of a type of furnace for carrying out the MAGNETHERM process.

With respect to FIG. 1, (1) is the carbon lining covering the side walls; (2) is the refractory and heat insulating lining; (3) is the impervious outer body made of steel plates; (4) is the carbon base, and (5) is the current output; (6) is the tap hole for periodic removal of the residual ferro-silicon which has only a low silicon content and of the excess liquid slag. This tap hole is tightly closed when the furnace is in operation.

The dome of the furnace has a non-conducting and heat insulating lining (7). The wide opening (8) constitutes the tuyere which enables the magnesium vapors to flow towards the condensation chamber. The axial pipe (9) accommodates the vertical electrode (10) consisting of a graphite sleeve (11) which is permanently immersed in the liquid slag and attached to the lower end of a copper tube through which water circulates. An inlet pipe (12) is provided for the introduction of the reactants. (13—13) indicates the maximum upper level of the liquid slag and (14—14) indicates the minimum lower level.

The condensation chamber consists of two main parts, namely, the condenser, properly speaking, and the crucible for reception of the magnesium.

The condenser (15) has a refractory lining (16) and a vacuum tight steel plating forming the external wall. The inlet pipe (17) for vacuum pumps is mounted at the top and forms the upper covering to the condenser.

The condenser is connected to the furnace by the flange connection (18) which is adapted to be cooled by circulating water as are also all the other clamps of the furnace.

Thermo-electric couples are provided to measure the temperature at various points and temperature controls enable the various temperatures to be maintained at their predetermined values.

The magnesium produced is conducted as a vapor to the condenser (15) which is designed to condense the magnesium to a liquid which trickles down and collects in the crucible (19) where it may either be kept in the liquid state or solidified by cooling. The optimum condensation yield is obtained in this way.

The electric power is provided by an auto transformer in which the voltage can be varied continuously (or discontinuously with only very slight intervals). This arrangement is essential to enable the power output of the furnace to be controlled from moment to moment and hence also the course of the reaction by which the magnesium is produced.

The following is given as an example. A slag having the following composition:

$C_aO$: 54.90%
$SiO_2$: 24.60%
$Al_2O_3$:13.40%
MgO : 6.60% is used with a reducing agent consisting of ferrosilicon particles containing 75% Si and measuring 0 to 30 mm and a calcined dolomite containing 37% of MgO and measuring 3/30 mm before heat treatment. The process is carried out at a temperature of ca. 1550 to 1600° C. under a pressure of from 27 to 47 millibars and the magnesium is extracted with an extraction yield of at least 85%. The Mg content of the magnesium metal obtained is at least 99.60% and may be as high as 99.90%.

The residual ferrosilicon contains less than 20% of Si.

The magnesium oxide used for the MAGNETHERM process may be obtained from various sources, such, for example, as from sea water or from calcined dolomite in which the lime contributes to the formation of the slag.

In view of the flexibility of this process, magnesium from various sources may be used. The applicant has found that it is particularly advantageous to use, as source of magnesium oxide, waste products containing at least 20%, preferably at least 30% of MgO and at least 20%, preferably at least 25% of $Al_2O_3$, particularly slag left from the production of chrome iron, in particular carbon-containing chrome iron from certain types of ores which contain a high proportion of magnesium oxide.

Depending on the geographical source of the ores and the process employed for production of the chrome iron, the composition of these slags may vary within the following approximate limits (in percent by weight):

MgO:20–40%
$Al_2O_3$:20–35%
$SiO_2$:20–35%
CaO:<10%
$Cr_2O_3$:<10%
$TiO_2$:<1%
FeO:<5%
MnO:approx 0.15%

By comparison, a high quality calcined dolomite has a composition within the following approximate limits:

MgO:35–43%
$SiO_2$:1–2%
$Al_2O_3$:<1%
CaO:63–57%

The magnesium oxide content of the chrome iron slags is thus only slightly lower and some times even equal to that of calcined dolomite. The lime content; on the other hand, is relatively low while the alumina content is much higher. This last factor is an advantage.

It is known that, for obtaining optimum yields from the MAGNETHERM process, it is necessary to use a composition of slag within certain limits which determine both its melting point and its physico-chemical activity.

In particular, the molecular ratio of CaO to $SiO_2$ should be at least equal to 1.8 and preferably from 2.2 to 2.4, the molecular ratio of $Al_2O_3$ to $SiO_2$ should be at least equal to 0.26 and preferably from 0.30 to 0.33 and the MgO content should be between 3 and 8%.

The composition of the slag should be within the following limits:

CaO:54–58%
SiO:23–28%
$Al_2O_3$:11–15%
MgO:3–8.50%

Under these conditions, the melting point is in the range of from 1500° to 1700° C. The introduction into a furnace of chrome iron slag as source of magnesium oxide therefore requires a correction of the composition by various additions to maintain the composition of the slag within the limits indicated above. Furthermore, and this is also an object of the present invention, the composition of the reducing agent may be modified and a ferro-silico-aluminum may be used. The use of bauxite, which entails considerable difficulties since it must be used in a relatively pure state with a low iron oxide content, may thereby be reduced and even completely eliminated.

It has been found, in practice, that the most favorable composition of chrome iron slags is within the following limits, calculated in relation to the total ($SiO_2$+MgO+$Al_2O_3$):

MgO:≧30%
$Al_2O_3$:≧25%
$SiO_2$:≧35%

The content of silicon and aluminum in the ferro-silico-aluminum used as reducing agent should be calculated according to the composition of the chrome iron slag used and the qunatity introduced into the furnace so that the composition of the slag will be maintained within the limits indicated above.

Figure 2:
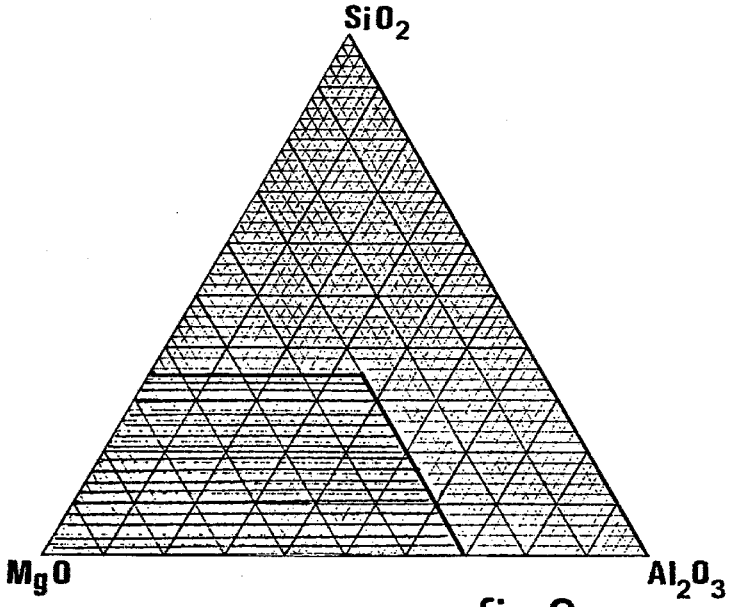
FIGS. 2 and 3 are diagrammatic representations of the preferential ferro-silico-chrome slags and ferro-silico-aluminum reducing agents of the instant invention.
Figure 3:
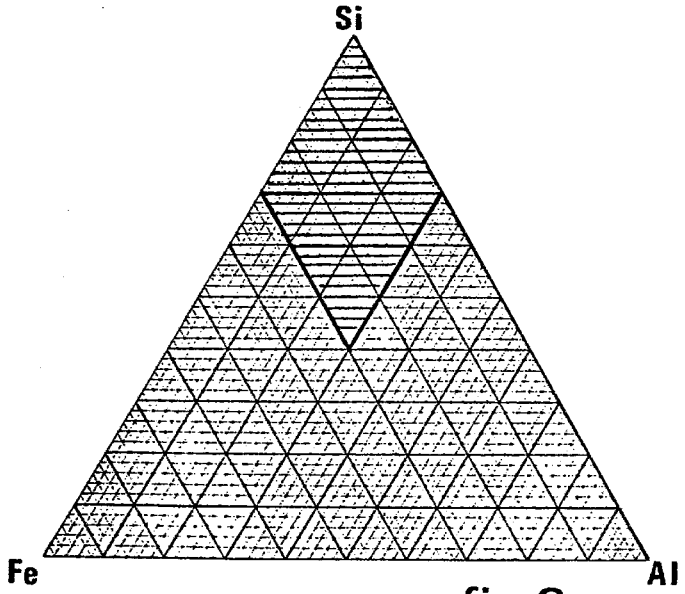

The triangular diagrams of FIGS. 2 and 3 indicate the shaded zones, the preferential compositions of ferro-silico-chrome slags (considering only the total $SiO_2$+MgO+$Al_2O_3$ content) and of the ferro-silico-aluminum reducing agent.

To demonstrate the significance and difficulty of using ferro-silico-aluminum as reducing agent, three tests were carried out using, as reducing agent, respectively, a 75% ferro-silicon with the addition of bauxite, and a ferro-silico-aluminum containing 8.60% of aluminum with the addition of bauxite and the same ferro-silica-aluminum without the additon of bauxite.

All three tests were carried out in a MAGNETHERM furnace of 2,000 KVA, using a chrome iron slag having the following composition:

MgO:36%
$SiO_2$:28%
$Al_2O_3$:27%
$Cr_2O_3$:3.20%
FeO:1.60%
CaO:2%
MnO:0.15%
$TiO_2$:0.35%

The data obtained from the three tests are summarized in the following table:

| | | Example 1 | Example 2 | Example 3 |
|---|---|---|---|---|
| Calcined dolomite | | 21,600 kg | 21,600 kg | 18,700 kg |
| FeCr slag | | 1,545 kg | 1,998 kg | 6,545 kg |
| Bauxite containing 74% $Al_2O_3$ | | 2,868 kg | 1,998 kg | — |
| Reducing agent | nature | FeSi 75% Si | FeSiAl 8.6 Al 66.0% Si | FeSiAl 8.6% Al 66.0% Si |
| | weight | 3,824 kg | 4,168 kg | 4,675 kg |
| Si content of residual FeSi | | 20% | 20% | 28% |
| Magnesium obtained as ingot after refining | | 3,500 kg | 3,660 kg | 1,760 kg |

Example 2 shows that if an 8.6% ferro-silico-aluminum is used, good results can be obtained only if bauxite is added in an amount substantially equal in weight to the chrome iron slag.

Example 3 shows that very poor results are obtained if bauxite is omitted because the composition of the slag is then imbalanced and no longer conforms to the optimum conditions for the reduction of magnesium oxide.

EXAMPLE 4

Into a MAGNETHERM furnace identical in construction to that described above, but with a power of 4,500 KVA, initially containing ca. 18 tons of molten slag having the following composition:

| | | |
|---|---|---|
| | $SiO_2$ | 25.40% |
| | $Al_2O_3$ | 12.20% |
| | CaO | 56.70% |
| | MgO | 5.40% |
| Molecular ratios | $CaO/SiO_2$ | 2.39% |
| | $Al_2O_3/SiO_2$ | 0.28% |

there were introduced:

Calcined dolomite containing 36.8% MgO:42,596 kg
FeCr slag:7,266 kg
FeSiAl containing 20% Al:8,114 kg
Energy consumption:72.1 MWh.

The FeCr had the following composition:

$SiO_2$:26.00%
$Al_2O_3$:27.00%
MgO:34.00%
$Cr_2O_3$:10.00%
$Fe^{O}$:1.60%
CaO:2.50%
MnO:0.15%
$TiO_2$:0.70% and the ferro-silico-aluminum had the following composition:

Al:19.00 1% Si:65.70% and the residual metal was found to contain 20% of silicon.

This operation, which lasted 15 hours, yielded 8,930 kg of magnesium ingot after refining.

This example demonstrates that if a ferro-silico-aluminum containing 20% of aluminum is used as reducing agent, the addition of bauxite can be completely omitted and yet the same yields and same quality of magnesium can be maintained. An aluminum content of between 15 and 25% provides satisfactory results in practice. Beyond this amount, there would be an excess of aluminum oxide in the slag, which would have to be compensated.

The use of chrome iron slags as source of magnesium has various advantages. This substance is completely dehydrated and has no tendency to take up water. There is therefore no need to calcine it before use as in the case of dolomite. Its storage even for prolonged periods requires no special precautions.

Its aluminum oxide content permits the addition of bauxite to be ommitted. This is an economical advantage as well as enabling the weight of the furnace charge (and hence also the volume) to be reduced by about 16% for the production of an equal amount of magnesium or, alternatively, the production capacity of a given furnace can be increased by 16% for an equal charge.

A normal "MAGNETHERM" charge is in fact calculated on the basis of

| | |
|---|---|
| 1,000 kg | of calcined dolomite (370 kg MgO) |
| 140 kg | of calcined bauxite (105 kg $Al_2O_3$) |
| 175 kg | of 75% ferro-silicon |
| 1,315 kg | |

This theoretically produces 223 kg of Mg (100% yield).

A charge according to this invention is calculated on the following basis:

| | |
|---|---|
| 1,000 kg of calcined dolomite (370 kg MgO) | |
| 170 kg of FeCr slag | 59 kg MgO |
| | 46 kg $Al_2O_3$ |
| 180 kg of FeSiAl | 20% Al |
| | 68% Si |
| 1,350 kg | |

The amount of Mg theoretically produced is 259 kg (100% yield), which is 16.1% more than in the first case. The weight of the charge is greater by 2.7% but the volume is slightly less due to the higher density of chrome iron slag.

An additional advantage of the process of this invention lies in the fact that the chromium initially contained in the chrome iron slag, either in the form of chromium oxide or in the form of metallic inclusions of chrome iron, passes virtually completely into the residual ferro-silicon which is collected at the end of each operation.

In the various operations which have been described, the residual alloy had a composition varying within the following limits:

Si:22.50–19.50%
Fe:60.00–58.00%
Al:0.16–0.17%
Cu:0.14–0.17%
Ti:1.20–1.70%
Mn:0.40–0.50%
Ca:0.13–0.07%
Cr:14.20–16.20%

This ferro-silicon-chrome residual alloy may be reintroduced into certain operating cycles for the production of ferrochrome or crude chromium.

We claim:

1. A thermal process for the production of magnesium in a closed electric furnace in which magnesium oxide and a metallic reducing agent react in the presence of a molten slag to produce magnesium vapors which are transmitted from the reaction furnace to a condensation zone wherein the vapors are condensed to magnesium, the improvement wherein at least a part of the magnesium oxide is introduced into the furnace in the form of a slag from the manufacture of ferro-chromium and which contains at least 20% by weight magnesium oxide and at least 25% by weight aluminum oxide, and in which the molten slag is formed essentially of lime, silica and alumina present in the molecular ratio of $CaO/SiO_2$of at least 1.8 and $Al_2O_3/SiO_2$ of at least 0.26.

2. A process as claimed in claim 1 in which the lime, silica and alumina are present in the molten slag in the molecular ratio of $CaO/SiO_2$ within the range of 2.2–2.4 and $Al_2O_3/SiO_2$ are present within the range of 0.3–0.33.

3. The process as claimed in claim 1 in which the metallic reducing agent is a ferro-silico-aluminum metal containing more than 8% by weight of aluminum.

4. A process as claimed in claim 3 in which the ferro-silico-aluminum contains 15–25% by weight of aluminum.

5. A process as claimed in claim 1 which includes the additional step of reclaiming the metallic reducing agent as a residual containing chromium and recycling said residual metal for the production of ferro-chromium or crude chromium.

6. The process as claimed in claim 1 which includes maintaining the slag at a temperature within the range of 1500–1700° C. during the reaction for reducing the magnesium oxide in the slag.

7. The method as claimed in claim 1 which includes the step of maintaining the pressure in the closed electric furnace within the range of 27–47 millibars.

* * * * *